US005359314A

United States Patent [19]

McQuay et al.

[11] Patent Number: 5,359,314

[45] Date of Patent: Oct. 25, 1994

[54] CORE AND COIL ASSEMBLY FOR AN AMORPHOUS-STEEL CORED ELECTRIC TRANSFORMER

[75] Inventors: Edgar E. McQuay, Conover; William E. McCain; Ram R. P. Sinha, both of Hickory, all of N.C.

[73] Assignee: General Electric Company, Schenectady, N.Y.

[21] Appl. No.: 84,132

[22] Filed: Jul. 1, 1993

[51] Int. Cl.[5] ..... H01F 27/26; H01F 27/30

[52] U.S. Cl. ..... 336/192; 336/210; 336/215; 336/219

[58] Field of Search ..... 336/212, 219, 210, 5, 336/214, 213, 215, 234, 197, 92

[56] References Cited

U.S. PATENT DOCUMENTS

| | | | |
|---|---|---|---|
| 3,082,390 | 3/1963 | Peterson | 336/210 |
| 3,374,453 | 3/1968 | Broverman | 336/197 |
| 4,663,605 | 5/1987 | Lee | 336/234 |
| 4,673,907 | 6/1987 | Lee | 336/92 |
| 4,707,678 | 11/1987 | Siman | 336/219 |
| 4,734,975 | 4/1988 | Ballard et al. | 336/234 |

OTHER PUBLICATIONS

Bulletin GEA 11085A, dated Nov. 1984, Three-Phase Pad-Mounted Transformers; 8 pages; General Electric Company, Hickory, N.C.

*Primary Examiner*—Thomas J. Kozma

*Attorney, Agent, or Firm*—William Freedman; Robert C. Lampe, Jr.; James E. McGiness

[57] ABSTRACT

This transformer core and coil assembly comprises (a) a low voltage coil surrounding a coil window and including first and second coil legs on opposite sides of the coil window, (b) a first plurality of side-by-side amorphous-steel core loops surrounding one of the coil legs, and (c) a second plurality of side-by-side amorphous-steel core loops surrounding the other of the coil legs. Extending between said coil legs in a position between two of said side-by-side core loops in the first plurality and between two of said side-by-side loops in the second plurality is a brace of plate form and of electrical insulating material for blocking motion of said coil legs toward each other in response to coil-collapsing forces developed by short-circuit currents through the low voltage coil, thereby protecting the amorphous-steel core loops from damage by these short-circuit produced forces tending to collapse the coil.

6 Claims, 3 Drawing Sheets

CORE AND COIL ASSEMBLY FOR AN AMORPHOUS-STEEL CORED ELECTRIC TRANSFORMER

TECHNICAL FIELD

This invention relates to a core and coil assembly for an amorphous-steel cored electric transformer and, more particularly, to an assembly of this type that includes means for preventing damage to the amorphous-steel core structure as a result of mechanical forces developed by short-circuit currents through the coil structure.

BACKGROUND

In the usual power transformer the coil structure comprises a low voltage coil surrounding a coil window and a high voltage coil surrounding the low voltage coil. The core structure in such a transformer comprises a core loop having a leg extending through the coil window. Should a short circuit occur on the load side of the transformer as a result of an equipment or cable failure, short-circuit currents, typically of high magnitude, will flow through the low voltage coil and produce high mechanical forces tending to collapse the low voltage coil onto the leg of the core loop.

In the traditional transformer having a core of silicon steel, the core leg has been able to resist such collapse of the surrounding low voltage coil without significant impairment. Such silicon steel core has sufficient stiffness and other properties to enable it to resist this mode of collapse without significant damage to the core. But in certain other types of transformers, the core does not have sufficient stiffness to resist such collapse of the surrounding coil without impairment. An example of such a transformer is one having a core of amorphous steel. Although amorphous steel cores have many advantages, they are subject to the disadvantage that they are sensitive to mechanical stresses, and core loss in such cores will significantly increase if they are subjected to the type of short-circuit produced stresses described hereinabove.

OBJECTS AND SUMMARY

An object of our invention is to construct an amorphous-steel-cored transformer in such a manner as to limit to relatively low values any increase in core loss resulting from coil-collapsing mechanical forces developed by short-circuit currents through the coil structure of the transformer.

Another object is to provide in an amorphous-steel-cored transformer simple and compact means for resisting short-circuit-produced collapse or expansion of the coil structure.

In carrying out our invention in one form, we provide a transformer core and coil assembly comprising (a) a low voltage coil surrounding a coil window and including first and second coil legs on opposite sides of the coil window, (b) a high voltage coil surrounding the low voltage coil, (c) a first plurality of side-by-side amorphous-steel core loops surrounding one of the coil legs, and (d) a second plurality of side-by-side amorphous-steel core loops surrounding the other of the coil legs. Extending between said coil legs in a position between two of said side-by-side core loops in the first plurality and between two of said side-by-side core loops in the second plurality is a brace of plate form and of electrical insulating material for blocking motion of said coil legs toward each other in response to coil-collapsing forces developed by short-circuit currents through the low voltage coil.

Each of the core loops is made of amorphous steel strip wound in turns about a window of the core loop, each turn having an edge located at one side of the core loop. The side-by-side core loops on a given leg of the coil are blocked from separating on the leg and have said one side facing the brace interposed between these core loops. The core loops are located sufficiently close to the interposed brace that any tendency of the brace to buckle when subjected to coil-collapsing force is opposed by a reaction force from each of the adjacent core loops acting longitudinally of the window of the core loop.

BRIEF DESCRIPTION OF FIGURES

For a better understanding of the invention, reference may be had to the following detailed description taken in connection with the accompanying drawings, wherein.

DETAILED DESCRIPTION OF EMBODIMENT

Figure 1:
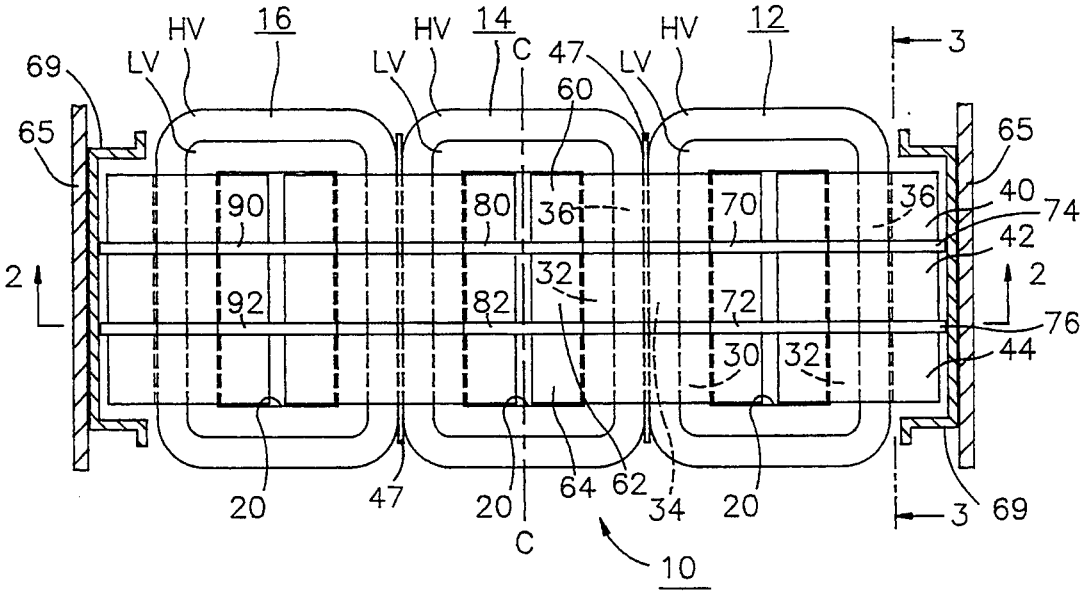
FIG. 1 is a plan view of a core and coil assembly embodying one form of our invention. For simplicity, most of the usual support and clamping means for the assembly has been omitted from FIG. 1. This support and clamping means is illustrated in FIGS. 3 and 5.
Figure 2:
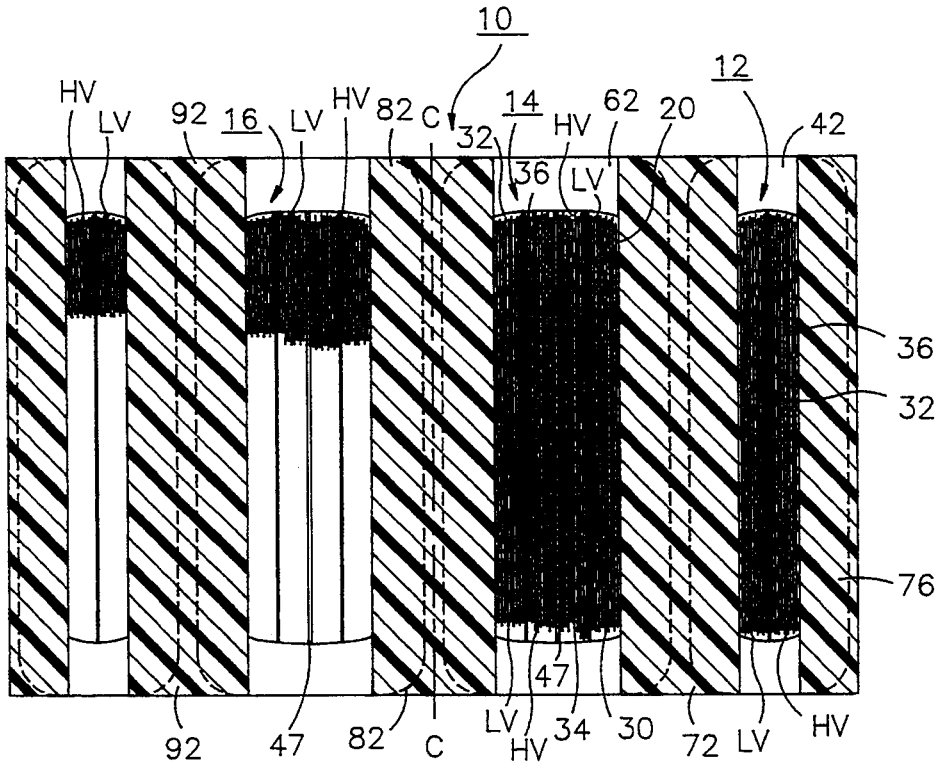
FIG. 2 is a sectional view taken along the line 2—2 of FIG. 1.

Referring now to FIGS. 1 and 2, the core and coil assembly 10 depicted therein is for use in a three-phase transformer and comprises three essentially identical coil structures 12, 14, and 16 disposed in side-by-side relationship. Each of these coil structures is of tubular form and is rectangular in cross-section as viewed in FIG. 1. Each of the coil structures comprises a low voltage coil LV surrounding a coil window 20 and a high voltage coil HV closely surrounding the low voltage coil LV. Each low voltage coil LV comprises a pair of spaced-apart legs 30 and 32 on opposite sides of the coil window 20. Each high voltage coil comprises a pair of spaced-apart legs 34 and 36 respectively located radially-outward of the legs 30 and 32 of the low voltage coil that it surrounds. In a typical form of this transformer, the low voltage coil LV is of aluminum sheet wound in a spiral form with one or more sheets of insulating material wound and located between each turn of the aluminum sheet; and the high voltage coil HV is of insulation-coated wire helically wound in a conventional manner. An insulating sheet (not shown) of suitable conventional form is present between the high voltage and the low voltage coils. Also a thin-walled liner (not shown) of insulating material is usually present within the window 20 for covering the entire surface of the window.

Figure 4:
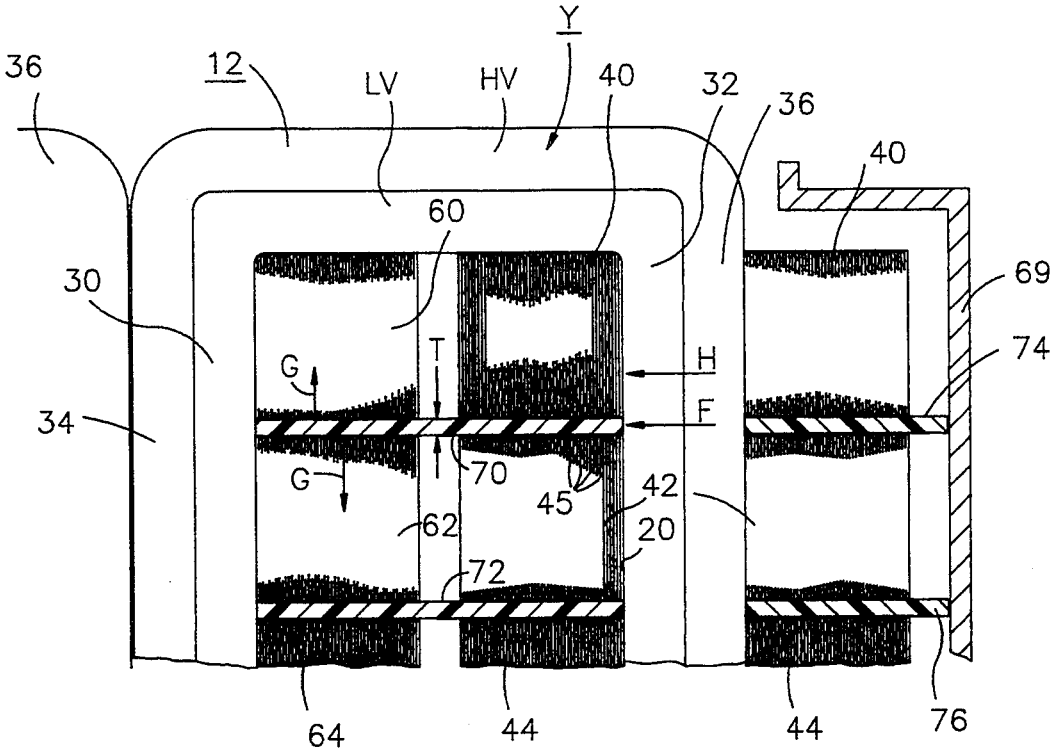
FIG. 4 is an enlarged cross-sectional view taken along the line 4—4 of FIG. 3 and showing certain components of the assembly in a representative region of the assembly.

Surrounding the right-hand leg 32,36 of the coil structure 12 are three core loops 40, 42, and 44 disposed in closely-spaced, side-by-side relationship. Each of these core loops is made of amorphous steel strip wrapped about the window of the core loop. An example of such a core loop is disclosed in more detail and claimed in U.S. Pat. No. 4,734,975 —Ballard et al, which is incorporated by reference in the present application. As will be evident from that patent, the amorphous steel strip is wrapped in turns about the core window and has its lateral edges located at the sides of the core loop. FIG. 4 of the present application schematically shows the amorphous steel strip at 45.

Each of the other two coil structures 14 and 16 is constructed in essentially the same manner as described above with respect to coil structure 12. In each of these coil structures 14 and 16, the high voltage coil is designated HV and the low voltage coil LV. In each of these coil structures, the high voltage coil HV closely surrounds the low voltage coil LV and is separated therefrom by a suitable sheet of electrical insulating material. The right-hand leg 32,36 of coil structure 14 is located adjacent the left-hand leg 30,34 of coil structure 12 and is electrically insulated therefrom by one or more thin electrical insulating members 47 disposed between these legs.

Surrounding the adjacent legs 30,34 of coil structure 12 and 32,36 of coil structure 14 are three horizontally-spaced core loops 60, 62, and 64. Each of these core loops 60, 62, 64 surrounds both coil legs 30, 34 and 32, 36. Each of these core loops 60, 62, 64 is constructed of amorphous steel strips wrapped about a window of the core and is essentially the same as each of the above-described core loops 40, 42, and 44 except that the core loops 60, 62, and 64 are large enough to surround two coil legs (30,34 and 32,36) instead of the single core leg 32,36 that the core loops 40, 42, and 44 surround.

The core and coil assembly 10 is symmetrical with respect to a central vertical plane C—C (FIG. 1). Accordingly, the portion of the assembly to the left of this plane C—C is the same as that to the right and is believed to require no further detailed description.

Figure 3:
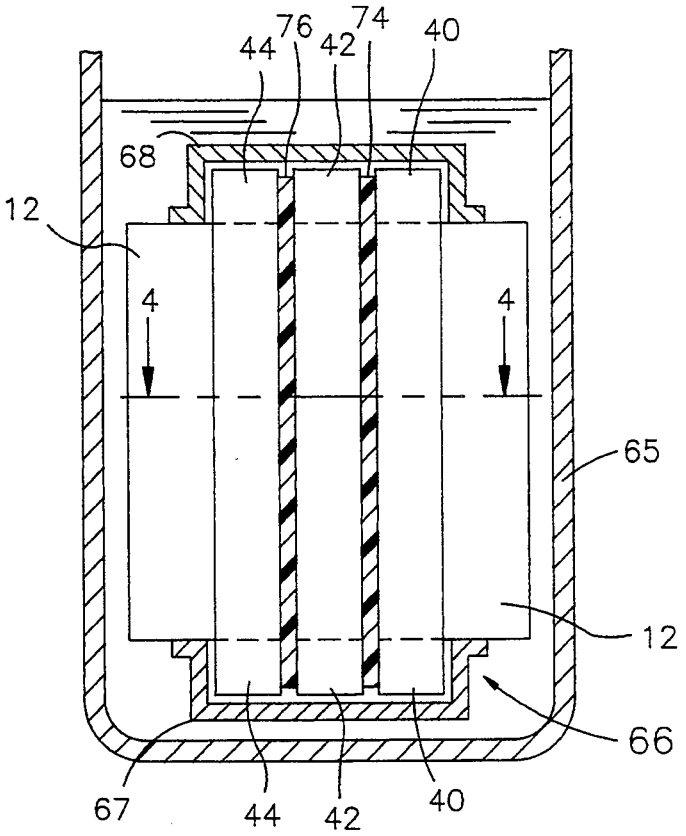
FIG. 3 is an end view of the core and coil assembly of FIG. 1 taken along the line 3—3 of FIG. 1 and showing support and clamping means for the assembly.
Figure 5:
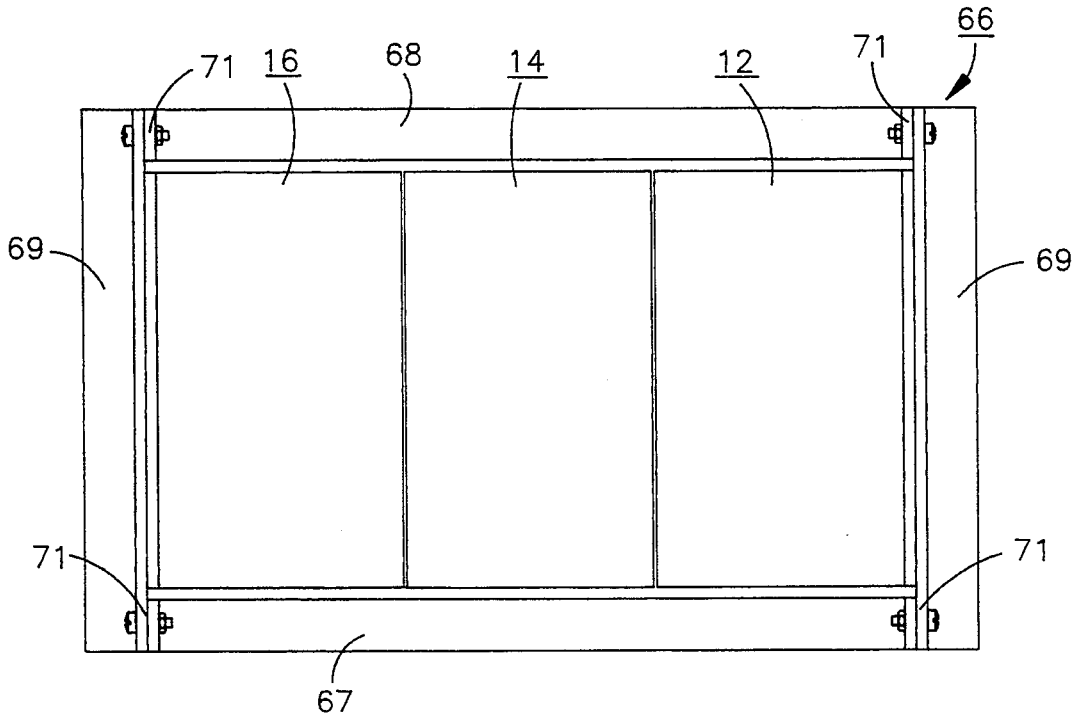
FIG. 5 is a side elevational view of the core and coil assembly of FIG. 3.

Referring to FIG. 3, the above-described core and coil assembly is mounted within an oil-filled tank, a portion of which is shown at 65 in FIG. 3. For positioning the assembly within the tank 65 and for holding the various parts together to assist them in resisting the forces developed during shipment, installation, and operation of the transformer, support and clamping means 66 is provided for the assembly. As shown in FIGS. 3 and 5, this support and clamping means 66 comprises (a) a lower channel 67 forming a horizontal support surface on which the coil structure 12, 14, and 16 rests, (b) an upper channel 68 located above the coil structure 12, 14, and 16, (c) two vertically-extending end channels 69 at horizontally-opposed ends of the coil structure 12, 14, and 16, and (d) suitable bolted joints 71 between the end channels and the upper and lower channels that allow for minor adjustments to be made in the spacing between the upper and lower channels and between the end channels. When the upper and lower channels are drawn together by the bolted joints, the coils 12, 14, and 16 are clamped between the upper and lower channels. The channels 67, 68, 69 form a box-like frame extending about the coil and core components that is fastened to the walls of the tank 65 by suitable fastening means (not shown).

As pointed out hereinabove under BACKGROUND, if a short-circuit should occur on the load side of the transformer, short-circuit current of high magnitude would flow through the short-circuited coil or coils of the transformer. Such current would develop high-magnitude forces tending to collapse the affected low-voltage coil about the leg or legs of the core that the coil surrounds. Such current would also develop high-magnitude forces on the affected high-voltage coil, tending to expand this coil. In a transformer of the type illustrated, these latter forces would be in a direction to bend outward the core leg or legs located just outside the high voltage winding. If the transformer cores are of amorphous steel these high magnitude forces, unless effectively managed, could damage the cores and thus cause an unacceptable increase in core losses.

In the illustrated transformer, we effectively resist the above-described short-circuit-produced forces without allowing them to damage the cores by providing special braces that block lateral displacement of the coil legs. One set of these braces is shown at 70 and 72 within the window 20 of coil 12. These braces 70 and 72 are of plate form and are made of a suitable substantially rigid electrical insulating material such as polyester resin reinforced with glass fiber. Each of these braces 70 and 72 extends the entire distance between the legs 30 and 32 of the low voltage portion of coil 12 and acts to block motion of the legs 30 and 32 toward each other in response to coil-collapsing forces developed by short-circuit currents through the low voltage coil. Brace 70 at its right-hand end is disposed between core loops 40 and 42 and at its left-hand end is disposed between core loops 60 and 62. The other brace 72 at its right-hand end is disposed between core loops 42 and 44 and at its left-hand end is disposed between core loops 62 and 64. These braces 70 and 72, when sandwiched between the core loops as shown, are stiff enough to substantially prevent motion of the coil legs 30 and 32 toward each other in response to short-circuit currents through the coil structure 12.

Each of the remaining coil structures 14 and 16 has a corresponding set of braces within its window that blocks motion of the associated low-voltage coil legs toward each other in response to short-circuit-produced forces. Referring to FIG. 1, the braces within coil structure 14 are designated 80 and 82, and those within coil structure 16 are designated 90 and 92. The braces in each coil window are positioned between the associated core loops in the same manner as described above for the braces in coil window 20 of coil structure 12.

Referring again to coil structure 12, as noted hereinabove, short-circuit currents therethrough develop forces on the high voltage coil HV of coil structure 12 that tend to expand this high voltage coil and thus force the right-hand leg 36 of the high voltage coil radially outward. To prevent these forces from exerting a damaging load on the associated amorphous steel cores 40, 42, and 44, we provide another set of braces 74 and 76 of plate form, this set being located outside the window 20 of the coil structure 12. Brace 74 is located between the core loops 40 and 42, and brace 76 is located between core loops 42 and 44.

The outer end of each of these braces 74 and 76 bears against the normally-stationary end channel 69 that is fixed to the transformer tank 65. This stationary vertically-extending end channel 69 extends for the full height of the cores 40, 42, and 44. When the high voltage coil HV of coil structure 12 attempts to expand radially outward, such outward motion is resisted by the braces 74 and 76, which bear at their outer ends against the stationary end channel 69 and at their inner ends against the right-hand leg 36 of the high voltage coil HV. By thus limiting outward movement of the leg 36 of the high voltage coil, the braces 74 and 76 protect the surrounding core structure from potential damage from such outward movement.

A noteworthy feature of our coil-bracing arrangement is its simplicity and compactness. The braces from which it is formed are simple plates of planar form that are relatively thin, thus enabling them to fit easily between the side-by-side core loops of the assembly and to consume little otherwise-usable space. Also, essentially no extra fastening means is required to hold them in place within the assembly.

Referring to FIG. 4, one feature that enables the bracing plate 74, despite its thinness (indicated at T), to withstand high forces (such as F) directed longitudinally of the bracing plate is that the plate 74 is prevented from buckling in response to these forces by the presence closely adjacent its lateral faces of the core loops 40 and 42. This buckling tendency acts in a direction to separate the core loops 40 and 42 along the leg 32,36 of the coil structure 12, but such separation is blocked by the yoke portions Y of the coil structure located behind the core loops. While this buckling tendency does apply force to the juxtaposed core loops in a direction G longitudinally of their windows, we have found that forces applied to wound amorphous-steel core loops in this direction can be effectively withstood by the core loops without significantly increasing core loss. This is in marked contrast to the detrimental effect on core losses of forces applied to such a core loop in a direction H perpendicular to the axis of the core loop window. The above-described buckling forces in a direction G are opposed by reaction forces directed axially of the core window and through the edges of the amorphous metal strip from which the core loops are constructed.

While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. A transformer core and coil assembly comprising:

(a) a low voltage coil surrounding a coil window and comprising first and second coil legs on opposite sides of said coil window, (b) a high voltage coil surrounding said low voltage coil, (c) a first plurality of side-by-side amorphous steel core loops surrounding one of said coil legs and extending through said coil window, (d) a second plurality of side-by-side amorphous steel core loops surrounding the other of said coil legs and extending through said coil window, and (e) a brace of plate form and of electrical insulating material extending between said coil legs for blocking motion of said coil legs toward each other in response to coil-collapsing forces developed by short-circuit currents through said low voltage coil, said brace being located between two of said side-by-side core loops in said first plurality of core loops and two of said side-by-side core loops in said second plurality of core loops.

2. A transformer core and coil assembly as defined in claim 1 and in which:

(a) said first plurality of core loops comprises first, second, and third core loops disposed in side-by-side relationship, (b) said second plurality of core loops comprises first, second, and third core loops disposed in side-by-side relationship, (c) said brace is disposed between the first and second core loops in each of said plurality of core loops, and (d) an additional brace of plate form and of electrical insulating material spaced from the brace of paragraph (c) extends between said coil legs for blocking motion of said coil legs toward each other in response to coil-collapsing forces developed by short-circuit currents through said low voltage coil, said additional brace being disposed between said second and third core loops in each of said plurality of core loops.

3. A transformer core and coil assembly as defined in claim 1 and in which:

(a) each of said core loops comprises a first core leg extending through said coil window and a second core leg located outside said coil window, (b) said high voltage coil includes first and second high-voltage coil legs on opposite sides of said coil window and respectively surrounded by the core loops of said first plurality and said second plurality of core loops, (c) normally stationary structure is disposed outside one of said second core legs of said first plurality of core loops, (d) a second brace of plate form and of electrical insulating material extends between said first high-voltage coil leg and said stationary structure and blocks motion of said first high-voltage coil leg toward said stationary structure, and (e) said second brace is located between the core loops of said first plurality of core loops.

4. A transformer core and coil assembly as defined in claim 3 and in which:

(a) said first plurality of core loops comprises first, second, and third core loops disposed in side-by-side relationship on said first high-voltage coil leg, (b) said second brace is disposed between said first and second core loops in said first plurality of core loops, and (c) a third brace of plate form and of electrical insulating material extends between said first high voltage coil leg and said stationary structure and blocks motion of said first high voltage coil leg toward said stationary structure in response to short-circuit currents through said high voltage coil, and (d) said third brace is located between said second and third core loops of said first plurality of core loops.

5. A core and coil assembly as defined in claim 1 and in which:

(a) said core loops are of amorphous steel strip wound in turns about a window of each core loop, the strip having an edge at one side of its associated core loop, (b) the core loops on each of said coil legs are blocked from separating from each other on their respective coil legs, (c) each of said core loops has said one side facing the brace that is interposed between the core loops on the associated coil leg, (d) said core loops are located sufficiently close to the interposed brace that any tendency of the brace to buckle when subjected to said coil-collapsing forces is opposed by a reaction force from each of the adjacent core loops acting longitudinally of the window of the core loop.

6. A core and coil assembly as defined in claim 3 and in which:

(a) each of the core loops of said first plurality is of amorphous steel strip wound in turns about a window of the core loop, the strip having an edge at one side of its associated core loop, (b) the core loops on said first high-voltage coil leg are blocked from separating from each other on said first high-voltage coil leg, (c) each of the core loops of said first plurality has said one side facing said second brace that is interposed between the core loops on said first high-voltage coil leg, and (d) the core loops of said first plurality are located sufficiently close to the interposed second brace that any tendency of the second brace to buckle when subjected to coil-expanding forces urging said first high-voltage coil leg toward said stationary structure is opposed by a reaction force from each of said adjacent core loops acting longitudinally of the window of the core loop.

* * * * *